US006511027B1

(12) United States Patent
Yu

(10) Patent No.: US 6,511,027 B1
(45) Date of Patent: Jan. 28, 2003

(54) WATER DISPENSER STAND WITH STORAGE

(76) Inventor: Charles Y. Yu, 20501 Belshaw Ave., Carson, CA (US) 90746

( * ) Notice: Subject to any disclaimer, the term of this patent is extended or adjusted under 35 U.S.C. 154(b) by 0 days.

(21) Appl. No.: 09/865,747

(22) Filed: May 29, 2001

(51) Int. Cl.[7] ..... A47G 23/02
(52) U.S. Cl. ..... 248/146; 211/74
(58) Field of Search ..... 248/146, 158, 248/161, 157, 163.1; 211/85.18, 74; 108/101, 45, 72, 92, 186

(56) References Cited

U.S. PATENT DOCUMENTS 730,322 A * 6/1903 Weston ..... 108/101
900,331 A * 10/1908 Weston ..... 108/101
1,518,148 A * 12/1924 Kamenstein ..... 211/200
1,917,564 A * 7/1933 Weston ..... 108/101
4,998,023 A * 3/1991 Kitts ..... 280/47.35
5,370,245 A * 12/1994 Tersch et al. ..... 211/74
6,290,074 B1 * 9/2001 Syvuk et al. ..... 211/74
2002/0000418 A1 * 1/2002 Miller, Jr. ..... 211/188

* cited by examiner

*Primary Examiner*—Ramon O Ramirez
*Assistant Examiner*—Kofi Schulterbrandt
(74) *Attorney, Agent, or Firm*—Allen A Dicke, Jr.

(57) ABSTRACT

The water dispenser stand with storage provides a top platform which is configured to support a ceramic water jar which receives an inverted water bottle on top thereof. There are water bottle holders between its legs for storage of water bottles which are not in use. The structure is configured so that it may be shipped disassembled. The legs may be made of metal or wood.

9 Claims, 4 Drawing Sheets

WATER DISPENSER STAND WITH STORAGE

FIELD OF THE INVENTION

This invention is directed to a stand especially configured to carry a ceramic water jar in dispensing position on its top and to carry one or more water bottles in storage position between its legs.

BACKGROUND OF THE INVENTION

Many householders prefer to use drinking water from a bottle because it is from a known source. This is wise in many countries foreign to the United States, and many persons carry this cultural preference with them when they come to the United States. Others prefer the flavor of bottled water or require water which is low in sodium or other minerals.

For these and related reasons, bottled water is commonly available in the United States. It is purchased or delivered in large bottles, such as 3-gallon and 5-gallon bottles. Such bottles are difficult to use when it is desired that only a small amount of water be dispensed. Because of this, several dispensing structures are available. One of these dispensing structures is a ceramic jar with a valve and spout on the side thereof. When the jar is filled with water and the valve is opened, the spout issues waters. These ceramic jars are configured to carry one of the large water bottles inverted on the top thereof. Thus, the water bottle dispenses water to the jar, as required, and the jar dispenses water from its valve and spout.

Since deliveries of water bottles are intermittent and since it is desired that a continuous supply be available for dispensing out of the spout, it is common to have on hand extra water bottles. Usually, these extra water bottles stand on the floor adjacent the dispenser. However, in such a position, they are in the way. It is desirable to have a suitable nearby location in which to store extra water bottles.

SUMMARY OF THE INVENTION

In order to aid in the understanding of this invention, it can be stated in essentially summary form that it is directed to a water dispenser stand with storage. The stand has at least three legs and a stand top supported by the three legs. The stand top is configured for carrying thereon a ceramic water jar. Between the legs, there is at least one bottle support configured to hold a water bottle which is not presently in use.

It is, thus, a purpose and advantage of this invention to provide a water dispenser stand with storage for extra water bottles which are not presently in use dispensing water.

It is another purpose and advantage of this invention to provide a water dispenser stand which is configured to receive a ceramic water dispensing jar on its top with the jar being configured to receive an inverted water bottle so that the jar dispenses water, together with storage in the stand for one or more water bottles not presently in use.

It is another purpose and advantage of this invention to provide a water dispenser stand which is configured so that it can be easily assembled so that it can be shipped in a compact configuration and assembled when needed.

It is a another purpose and advantage of this invention to provide a water dispenser stand which is ornamental so that its appearance at the water dispensing location is not objectionable.

Other purposes and advantages of this invention will become apparent from a study of the following portion of the specification, the claims and the attached drawings.

DESCRIPTION OF THE PREFERRED EMBODIMENT

Figure 1:
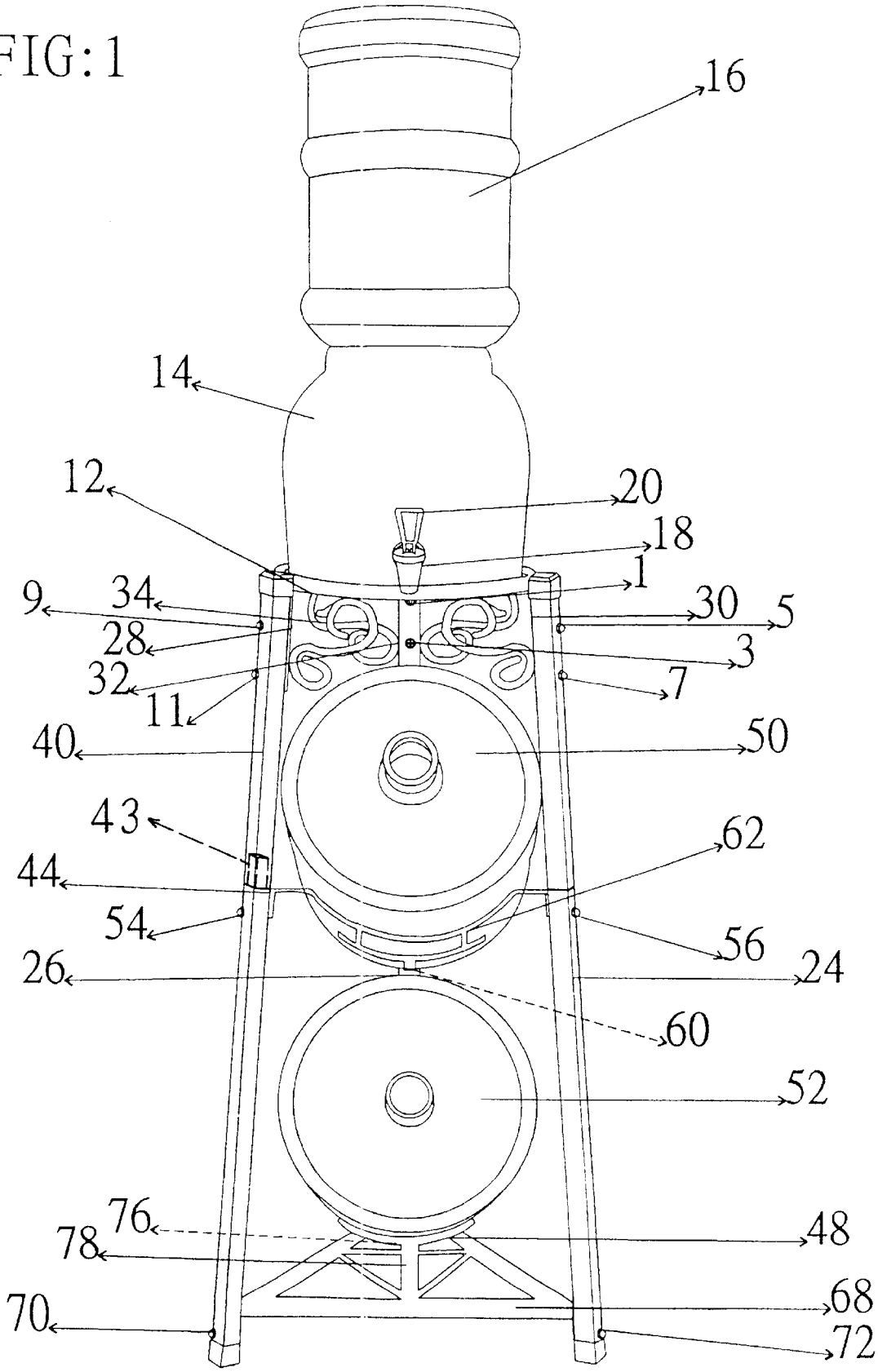
FIG. 1 is a front-elevational view of a water dispenser stand in accordance with this invention shown storing two water bottles together with a water jar on the top and a water bottle inverted into the jar.

The water dispenser stand with storage of this invention is generally indicated at 10 in FIG. 1. The stand has a top platform 12, which is sized to support a ceramic water jar 14. The water jar 14 has a large top open mouth on which can be inverted a water bottle 16. The water bottle 16 is usually made of glass or polymer composition material and is usually of 2- to 5-gallons in size. The water empties into jar 14 until the water level in jar 14 rises to the neck of the water bottle. If the user desires water, he dispenses it to himself from water spout 18, which is fitted to the side of the water jar near its bottom. The flow in the water spout is controlled by valve 20.

Figure 6:
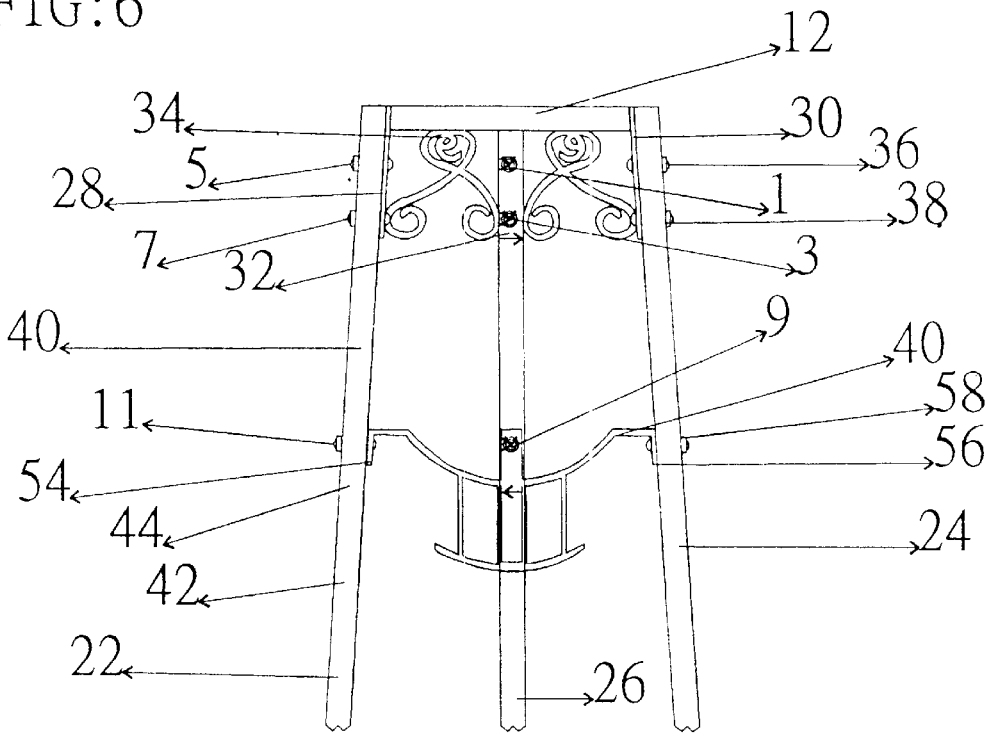
FIG. 6 is an enlarged front-elevational view of the water dispenser stand of FIG. 1, with the lower part of the legs broken away.

Three legs support the top platform 12. As seen from the front, the legs comprise left leg 22, right leg 24, and back leg 26. The top platform has three leg brackets secured thereto. The leg brackets are seen in FIGS. 1 and 6 and include left leg bracket 28, right leg bracket 30, and back leg bracket 32. The leg brackets are secured to the top platform 12 and may be made of the same material and form a unitary part thereof. For example, the top platform may be a metal ring with a floor in it, and the leg brackets may be welded thereto. The leg brackets may be strengthened by braces, such as the functional and decorative brace 34 shown with respect to bracket 28. There is a corresponding functional and decorative brace for the bracket 30 and there may also be one for the bracket 32. The top platform 12 is circular, and the leg brackets are positioned 120 degrees apart around the circumference thereof.

The legs 22, 24 and 26 are tubular metal legs and are preferably attached by screws such as machine screws passing through the legs and brackets. The machine screws 36 and 38 are shown with respect to the bracket 30. They may have a head on the outside and be threaded through corresponding holes in the bracket 30 or may have nuts thereon, preferably on the interior surface of the bracket 30. Each of the legs is attached in the same way.

The attachment of the legs by such fasteners as machine screws or sheet metal screws permits assembly after shipping from the manufacturer by the ultimate user or by the retailer. This saves considerable volume in the shipping of the water dispenser stands. Another way of providing compact shipping includes configuring the legs 22, 24 and 26 in two telescoping parts which may be disassembled during shipping and assembled into full length thereafter. In FIGS.

1 and 6, it is seen that the tubular leg 22 43 has an upper section 40 and a lower section 42, which are joined at a telescopic joint 44. The lower tube 42 is a slightly reduced upper nose 43 which fits into the lower end of the upper tubular end of the upper tubular section 40. Dividing the legs during shipment and joining them during assembly of the water dispenser stand saves further shipping space.

Another feature of the water dispenser stand of this invention is the presence of two bottle holders. As seen in FIG. 1, there is an upper bottle holder 46 and a lower bottle holder 48 respectively holding upper water bottle 50 and lower water bottle 52. The upper and lower water bottles 50 and 52 are not in active use, but are stored for future use or comprise empty bottles from which the water has already been dispensed.

Figure 4:
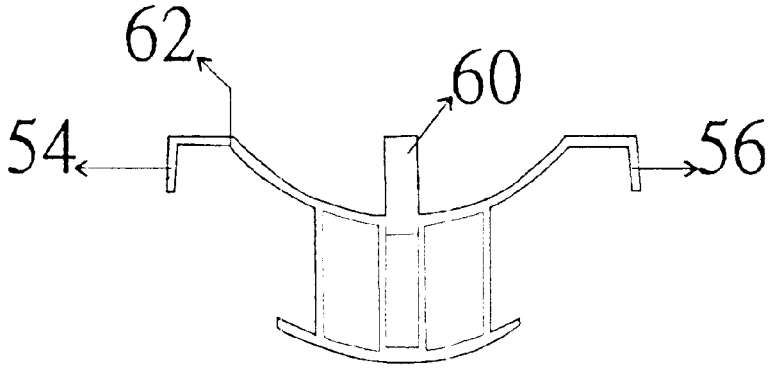
FIG. 4 is an end view of the middle bottle support.
Figure 5:
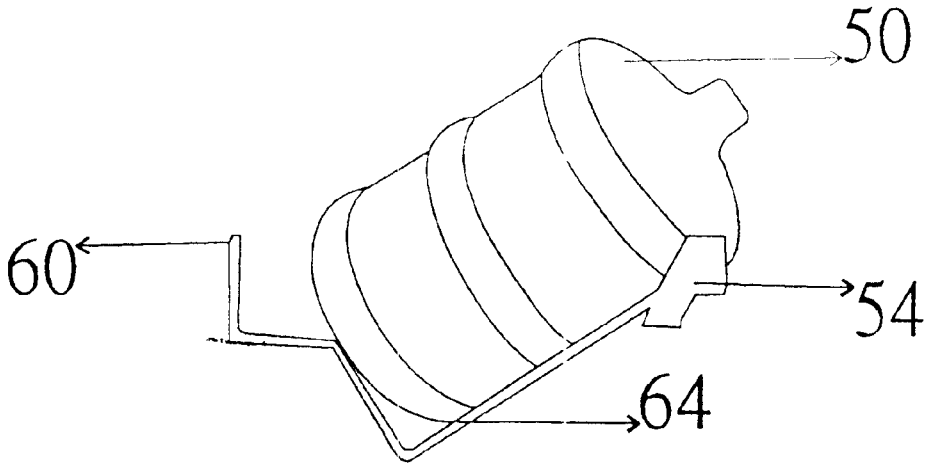
FIG. 5 is a side view thereof.

As seen in FIGS. 4 and 5, the upper bottle holder 46 has left and right arms 54 and 56 which are respectively secured to the left and right legs 22 and 24, as seen in FIG. 6. These arms are secured to the legs in the same manner by a fastener 58 in each leg which is the same as the fastener 38. In addition to securing the upper water bottle holder 46 in place between the legs, these fasteners also pass through both portions of the telescoping leg sections to prevent them from coming apart. The upper bottle holder 46 also has a back arm 60, which attaches to the back leg 26. Between the arms, the upper bottle holder 46 is configured as a holder or a cradle, which includes a curved front section 62 of substantially the same radius as the water bottle 50 being stored therein. Behind the front curved section 62, the upper bottle holder 56 extends backward in bar 64, which includes bottom rest 66 against which the upper bottle rests when it is in position, as seen in FIG. 5. The upper water bottle holder 46 is also seen in FIG. 6.

Figure 2:
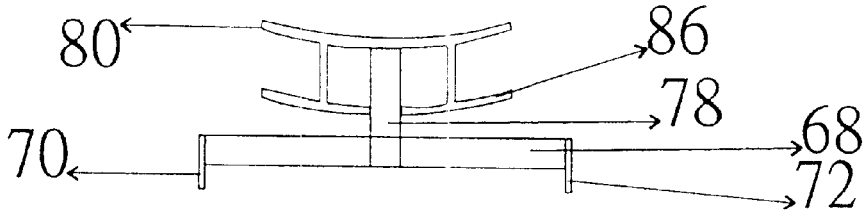
FIG. 2 is an end view of the lower bottle storage support.
Figure 3:
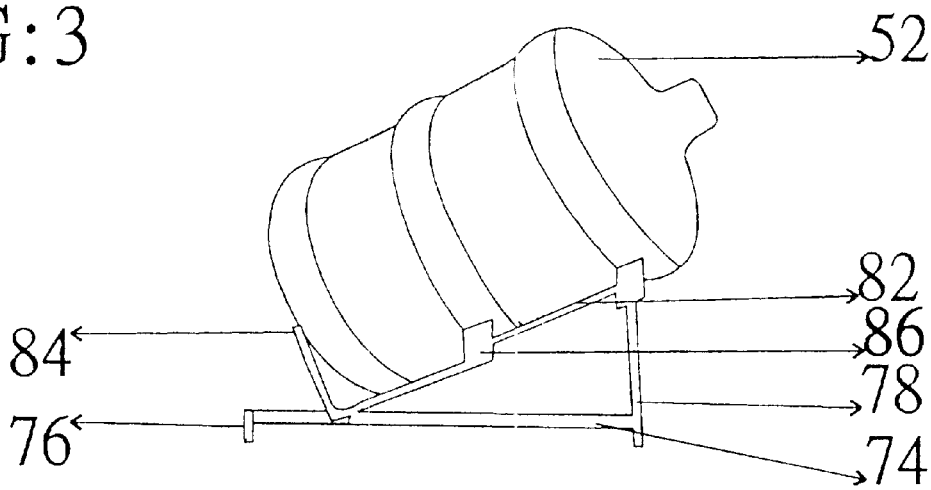
FIG. 3 is a side view thereof.

The lower bottle holder 48 is not shown in FIG. 6 because the legs are broken away therein, but it is seen in FIG. 1 and is seen in front- and side-elevational view in FIGS. 2 and 3. The lower bottle holder 48 has a front bar 68 which has left and right arms thereon, which are secured adjacent the bottom of the legs 22 and 24 by the same attachment as used on the top, for example, machine screws 70 and 72 through the arm and leg.

Bar 74 extends to ward the back and has a flange 76 thereon, which is attached to the back leg 26, see FIG. 1. Support arm 78 extends upward from the middle of front bar 68. At the top, it Carries a yoke 80 which serves as a front bottle support or cradle. It has substantially the same radius as the bottle. Support bar 82 extends backward and downward from yoke 80, is attached to the bar 74, and extends upward to create bottom rest 84. A second yoke 86 is preferably formed intermediate the ends of support bar 82. The lower bottle holder 48 can be configured to hold a larger bottle than the bottom holder 46 because there is greater distance between the divergent legs of the dispenser stand. The lower bottle holder is preferably configured to hold a 5-gallon water bottle, or the like.

When it is received, the water dispenser stand is assembled with the indicated screws. Thereupon, the water jar 14 is placed in its top, and a water bottle 16 is inverted thereon so that the stand is performing its principal function of supporting the water jar and the water bottle thereon. Extra water bottles are then placed on the bottle holders 46 and 48 as required. As previously discussed, they can be full or empty, as the occasion arises.

Figure 7:
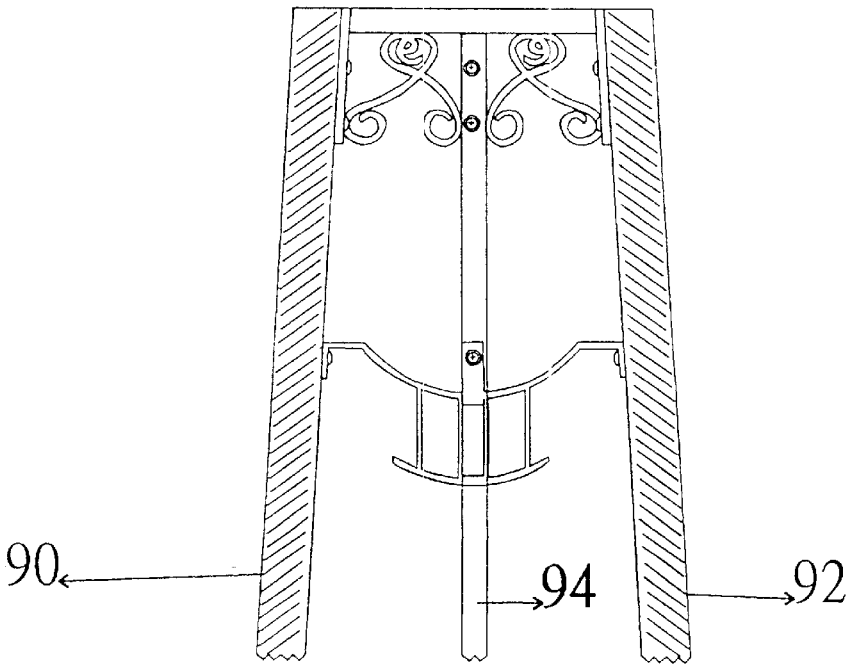
FIG. 7 is a view similar to FIG. 6, but showing alternate leg structure.

The stand 88 shown in FIG. 7 is the same as stand 10, except that the legs 90, 92 and 94 are made of wood. Wood screws attach the top platform and upper and lower bottle holders to the legs. The stand 88 may be preferred by some users to fit the decor better. It can also be shipped disassembled and assembly accomplished by the retailer or user.

This invention has been described in its presently preferred embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A water dispenser stand with storage, comprising:

a platform sized to receive a water jar;

first, second and third spaced legs detachably attached to said platform to support said platform, each of said first, second and third legs being formed of upper and lower sections, said upper and lower sections of said legs being detachably joined together with a telescoping joint, at least one of said upper and lower sections being tubular at said telescopic joint and telescopically receiving the other of said upper and lower sections so that said upper and lower sections are telescopically overlapped with each other to form each said leg;

an upper bottle holder and a lower bottle holder each positioned between said legs and below said platform, said upper bottle holder and said lower bottle holder each being curved and sized to releasably hold at least partially on its side a water bottle which can be removed from its water bottle holder and mounted on the top of the water jar, said upper bottle holder and said lower bottle holder being attached to said legs by removable fasteners for support by said legs.

2. The water dispenser stand with storage of claim 1 wherein said first, second and third legs are downwardly divergent from each other and said lower bottle holder is configured to hold a larger water bottle than said upper bottle holder.

3. The water dispenser stand with storage of claim 1 wherein said removable fasteners supporting said upper bottle holder pass through said telescopic overlapped sections of said upper and lower leg sections so that said removable fasteners supporting said upper bottle holder also retain said telescopic overlapping sections in engagement.

4. A water dispenser stand with storage, comprising:

a top platform sized to support a water jar;

first, second and third leg brackets attached to said platform;

first, second and third legs detachably attached to said first, second and third leg brackets, respectively, said legs being attached by removable leg fasteners extending through said legs into said leg brackets;

an upper bottle holder and a lower bottle holder positioned between said first, second and third legs, said upper bottle holder being positioned between said top platform and said top shelf, said upper bottle holder and said lower bottle holder each being detachably attached to said first, second and third legs so that said top platform and said upper and lower bottle holders serve to position said legs, said lower bottle holder being sized and curved to releasably receive a water bottle at least partially on its side so that when stored in said lower bottle holder a water bottle is substantially positioned between said legs, said upper bottle holder being positioned above said lower bottle holder and below said top platform, said upper bottle holder being detachably attached to said first, second and third legs, said upper bottle holder being sized and curved to releasably receive a water bottle at least partially on its side and, when positioned on said upper bottle holder, the water bottle thereon is positioned substantially between said legs.

5. The water dispenser stand with storage of claim 4 wherein said lower bottle holder is sized and configured to hold a bottle of larger size than can be held by said upper bottle holder.

6. A water dispenser stand with storage, comprising:

a top platform sized to support a water jar;

first, second and third leg brackets attached to said platform;

first, second and third legs detachably attached to said first, second and third leg brackets, respectively, said legs being attached by removable leg fasteners extending through said legs into said leg brackets;

each of said legs being formed in upper and lower sections, said sections being configured so that said sections telescopically interengage to form a leg, said upper bottle holder being positioned between said legs adjacent said telescopic overlap of said leg sections and there are releasable fasteners retaining said upper bottle holder in place, said releasable fasteners extending through said telescopic overlap section of said leg sections to retain said leg sections in telescopic interengagement, said upper bottle holder and said lower bottle holder each being detachably attached to said first, second and third legs so that said top platform and said upper and lower bottle holders serve to position said legs, said lower bottle holder being sized and curved to releasably receive a water bottle at least partially on its side so that when stored in said lower bottle holder a water bottle is substantially positioned between said legs, said upper bottle holder being positioned above said lower bottle holder and below said top platform, said upper bottle holder being detachably attached to said first, second and third legs, said upper bottle holder being sized and curved to releasably receive a water bottle at least partially on its side and, when positioned on said upper bottle holder, the water bottle thereon is positioned substantially between said legs.

7. The water dispenser stand with storage of claim 6 wherein said releasable fasteners are bolts.

8. The water dispenser stand with storage of claim 6, wherein said upper and lower water bottle holders are each configured to releaseably hold a water bottle with its neck positioned above its bottom.

9. The water dispenser stand with storage of claim 6 wherein said upper bottle holder and said lower bottle holder are each made of a metal frame.

* * * * *